US006182618B1

(12) United States Patent
Gutierrez, Jr.

(10) Patent No.: US 6,182,618 B1
(45) Date of Patent: Feb. 6, 2001

(54) INDEPENDENT COOLING SYSTEM FOR ALTERNATIVE INTERNAL COMBUSTION ENGINES

(75) Inventor: Henedino Gutierrez, Jr., Sao Paulo (BR)

(73) Assignee: General Motors Do Brasil LTDA, Sao Paulo (BR)

( * ) Notice: Under 35 U.S.C. 154(b), the term of this patent shall be extended for 0 days.

(21) Appl. No.: 09/284,021

(22) PCT Filed: Nov. 20, 1997

(86) PCT No.: PCT/BR97/00068

§ 371 Date: Jun. 7, 1999

§ 102(e) Date: Jun. 7, 1999

(87) PCT Pub. No.: WO98/38417

PCT Pub. Date: Sep. 3, 1998

(30) Foreign Application Priority Data

Feb. 24, 1997 (BR) ..... 9701062

(51) Int. Cl.[7] ..... F01P 3/00
(52) U.S. Cl. ..... 123/41.29; 123/41.28
(58) Field of Search ..... 123/41.28, 41.29

(56) References Cited

U.S. PATENT DOCUMENTS

| | | | | |
|---|---|---|---|---|
| 1,343,494 | * | 6/1920 | Bolger | 123/41.28 |
| 1,500,668 | * | 7/1924 | Church | 123/41.29 |
| 1,741,464 | | 12/1929 | Hunt . | |
| 1,774,881 | | 9/1930 | Fry . | |
| 1,789,540 | | 1/1931 | Brubaker . | |
| 2,216,802 | * | 10/1940 | Baster | 123/41.28 |
| 4,212,270 | * | 7/1980 | Nakanishi et al. | 123/41.09 |
| 4,726,324 | * | 2/1988 | Itakura | 123/41.1 |
| 4,726,325 | | 2/1988 | Itakura . | |
| 5,701,851 | * | 12/1997 | Nakano et al. | 123/41.1 |

FOREIGN PATENT DOCUMENTS

| | | | |
|---|---|---|---|
| A14442111 | | 6/1995 | (DE) . |
| 0894953A1 | * | 3/1999 | (EP) . |

* cited by examiner

*Primary Examiner*—Willis R. Wolfe
*Assistant Examiner*—Katrina B. Harris
(74) *Attorney, Agent, or Firm*—Birch, Stewart, Kolasch & Birch, LLP

(57) ABSTRACT

A cooling system for an internal combustion engine includes two independently operated subsystems, one for the cylinder head of the engine and one for the engine block. The cylinder head cooling subsystem includes a pump for flowing a first coolant from a first reservoir through a first radiator and the cylinder head of the engine. A temperature sensor is provided for measuring the first coolant temperature in the cylinder head cooling subsystem, and a control module responsive thereto for regulating the flow of the first coolant circulated by the pump. The engine block cooling subsystem is physically and functionally independent of the cylinder head cooling subsystem and includes a reservoir filled with a second coolant in fluid communication with a second radiator and a control device for controlling the flow of the second coolant to the engine block. The engine block cooling subsystem operates through natural thermodynamic flow without the use of a pump.

7 Claims, 4 Drawing Sheets

INDEPENDENT COOLING SYSTEM FOR ALTERNATIVE INTERNAL COMBUSTION ENGINES

APPLICATION AREA

The application is the national phase under 35 U.S.C. § 371 of PCT International Application No. PCT/BR97/00068 which has an International filing date of Nov. 20, 1997, which designated the United States of America.

This invention refers to an independent cooling system designed to cool, vehicular or stationary, internal combustion engines which operate with coolant in a closed-circuit system. The invention is characterized by performing the engine cooling through two independent closed-circuit subsystems. One of these two subsystems performs the engine cylinder-head cooling. The other one performs the engine block cooling.

BACKGROUND OF THE INVENTION

The current vehicular engine's cooling systems, basically, consist of a single radiator that exchanges heat between the whole coolant existent in the vehicle's engine cooling system (engine block plus cylinder head, hoses, radiator, etc.) and the surrounding air. In such a system, the engine block and cylinder head constitute a part of the flowing circuit, within which the engine block coolant and the cylinder head coolant mix, and vice-versa. Whenever the thermostatic valve is closed (opening temperature not reached), a mechanical pump generates the coolant flow between the engine block and the cylinder head only. As the thermostatic valve starts its opening process (the opening temperature was surpassed), coolant flow occurs inside the whole engine cooling system. The coolant pump continuously absorbs a fraction of the engine power output. In the current systems, there is no precise mass flow rate and coolant temperature control. A substantial amount of the engine power output is wasted by the coolant pump, due to the gross nature of the current system control. The coolant volume in the system is considerably high.

In the independent cylinder head cooling subsystem, according to the present invention, the correspondent flow circuit consists of the following components: cylinder head, electric or electromechanical coolant pump (to generate forced flow in the system), flow-controlling valve (to control the flow rate in the closed circuit), an independent primary radiator (to exchange heat with the surrounding ambient), a coolant temperature sensor (to measure the coolant temperature in a specific position in the flow circuit, and to make possible the control of the system's operation ), and an expansion and filling reservoir.

In the independent reservoir engine block cooling subsystem, according to the present invention, the respective coolant flow circuit consists of the following components: engine block, an independent secondary radiator (to exchange heat with surrounding ambient), and an expansion and filling reservoir.

The independent cooling system for internal combustion engines, according to present invention, is characterized by performing the engine block and the cylinder head cooling independently of each other. For the cylinder head, the cooling is accomplished by means of forced flow of coolant. For the engine block, the cooling is accomplished by means of natural (free) convection caused by buoyancy effects.

The independent cooling system for internal combustion engines, according to the present invention, permits distinct operating-regime temperatures in the cylinder head and in the engine block respectively. As a consequence, one can obtain better control of the engine heat rejection, better control of the air-fuel mixture temperature, better control of the engine pollutant emissions, faster cylinder head warming-up causing reduction in the engine cold-phase period, effective increase in the compression ratio (to much higher values than the currently attainable).

The fact that the independent cooling system for internal combustion engines, according to the present invention, makes it possible an increase in the engine compression ratio to very high values (for both Otto cycle and Diesel cycle engines), characterizes the system itself by causing a substantial increase in the engine thermal efficiency, yielding, as a consequence, lower fuel consumption and lower pollutant gases emissions.

The independent cooling system for internal combustion engines, according to the present invention, is also characterized by making it possible the control of the independent coolant forced flow through the cylinder head. Said control can be done by the Electronic Control Module which controls single- or multi-point fuel injection systems. The Electronic Control Module, via the coolant temperature sensor, measures the coolant temperature in a specified location and, as a function of that value and the engine operating regime (engine load and engine speed), controls the coolant pump and flow-controlling valve operation.

The independent cooling system for internal combustion engines, according to the present invention, also allows the primary and secondary radiators to be located in series or in parallel, in relation to the vehicle's longitudinal axis.

DESCRIPTION OF THE DRAWINGS

FIG. 1 shows the functional diagram of the engine cylinder head independent cooling subsystem (1), within which the coolant leaves from a expansion and filling reservoir (6), is pumped by an electromechanical or electric coolant pump (2), in order to generate the coolant forced flow to a primary radiator (4), which radiator exchanges heat with the surrounding air, and keeps the cylinder head coolant temperature on the specified level. By means of a flow-controlling valve (3), that controls the coolant flow in the independent closed circuit, the coolant gets to the cylinder head in order to cool it. A coolant temperature sensor (5) measures the temperature in a specified location of the coolant flow, making it possible a precise control of the system's operation, i. e., an accurate control of the heat transfer process.

FIG. 2 shows the functional diagram of the engine block (7) independent subsystem, where the coolant leaves from a expansion and filling reservoir (9) and flows naturally, by gravity, to an independent secondary radiator (8) where it exchanges heat with the surrounding ambient (air), and, after that, flows to the engine block (7) to cool it. As is known to the art, the heat flux rate to the cylinder head is higher than the heat flux rate, from the combustion gases to the engine block, so a simple natural (free) convection of the coolant in the engine block is sufficient to cool it.

FIG. 3, which is similar to FIG. 1, shows the electronic control module (10) that controls the general cooling operation. By receiving the signal from the coolant temperature sensor, the electronic control module measures the coolant temperature, and, as a function of the engine operating regime defined by the engine load and speed, controls the coolant pump (2) and the flow-controlling valve (3), according to the cylinder head cooling requirements. The electronic controls module (10) also controls, as shown in FIG. 3, the fan (11) operation. The electronic control module (10) may be a sophisticated microprocessor, of any kind, of any nature, that is suitable to execute such a function.

FIG. 4*b* shows, in the independent cooling system for internal combustion engines, according to the present invention, the arrangement of the primary (4) and secondary (8) radiators in series or in parallel, relatively to the vehicle's longitudinal axis. FIG. 4*a* shows the parallel arrangement of the primary (4) and secondary (8) radiators, also relatively to the vehicle's longitudinal axis.

Figure 1:
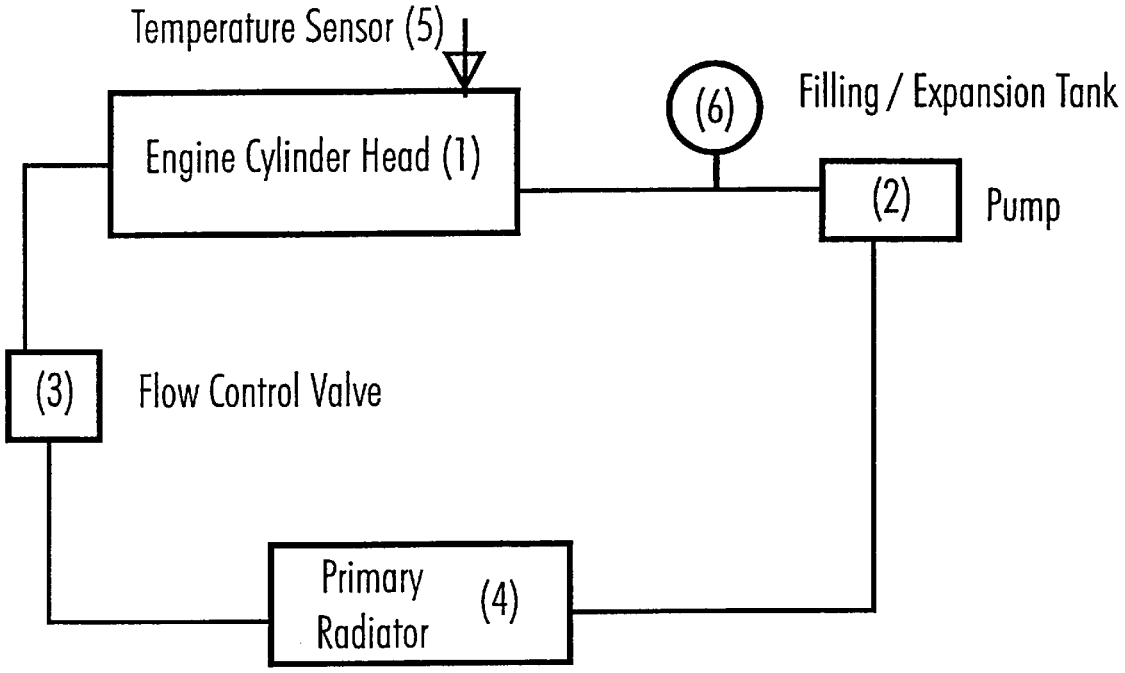
FIG. 1 shows the functional diagram of the cylinder head independent cooling subsystem.
Figure 2:
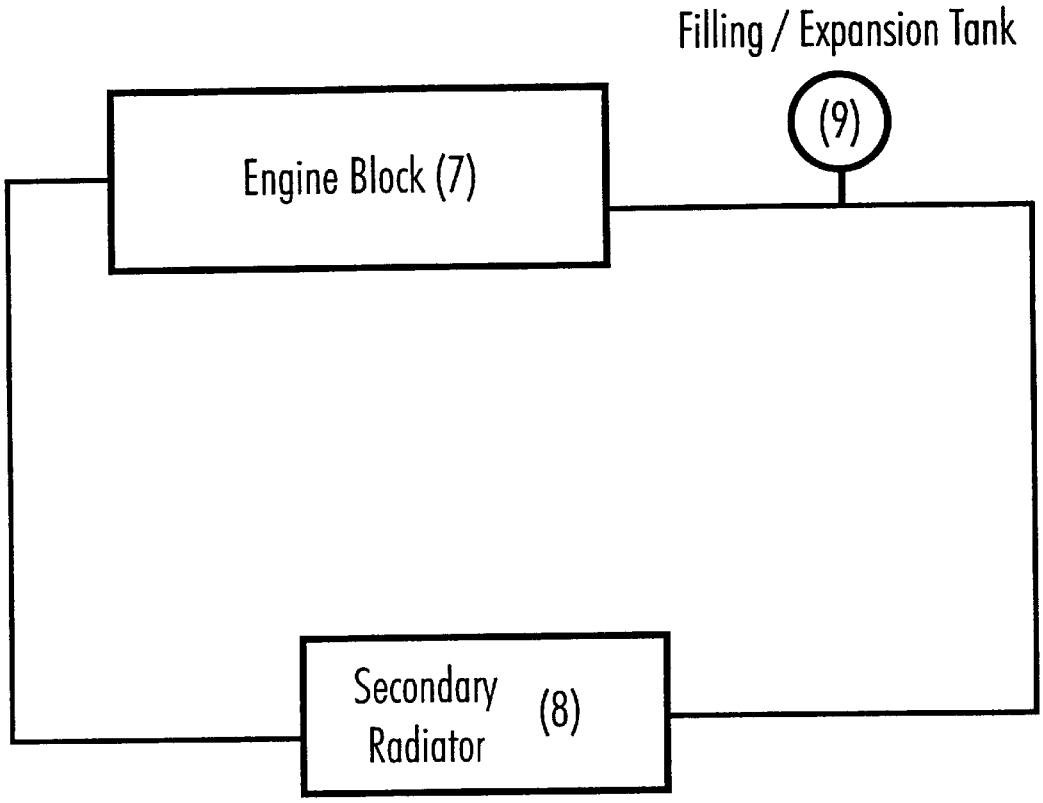
FIG. 2 shows the functional diagram of the engine block independent cooling subsystem.
Figure 3:
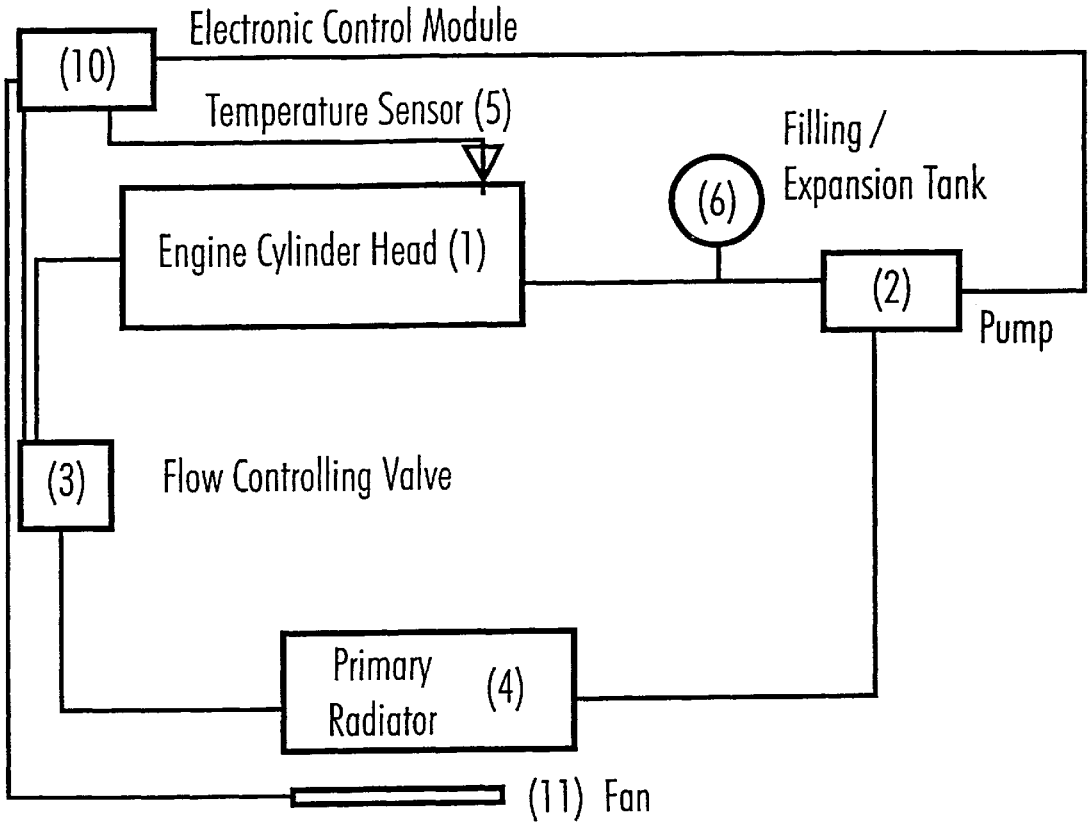
FIG. 3 shows the functional diagram of the cylinder head independent cooling subsystem, including the electronic control module that controls the ignition and fuel-injection systems.
Figure 4A:
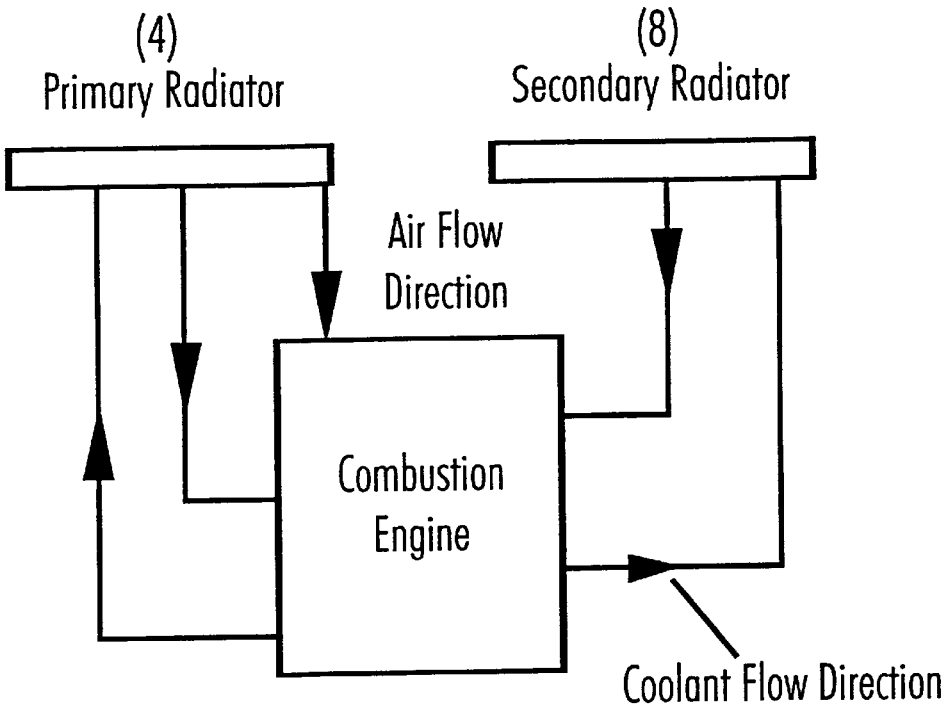
FIGS. 4*a* and 4*b* are diagrams showing the coolant flow direction in an arrangement where the primary and secondary radiators are disposed in series and in parallel relatively to each other.
Figure 4B:
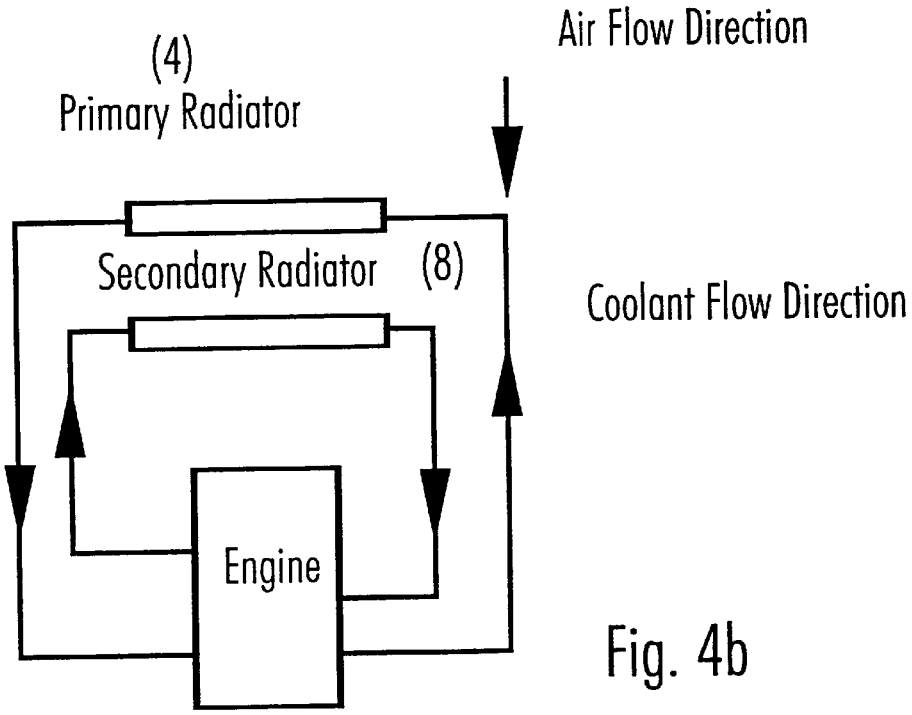

In the present invention, the coolant may be any kind of fluid, with any specific composition that is suitable for such a function. The preferable fluids are aqueous ones as, for instance, water mixed with additives (like glycol ethylene, etc.).

The system of the present invention can provide to the cylinder head, for instance, a temperature gradient (inlet-outlet) of around 50° C., and of around 40° C. for the engine block. However, an engine incorporating the claimed cooling system can operate at any coolant temperature gradient, either for the engine block or for the cylinder head.

In relation to the current cooling systems described in the beginning of the preceding section, the independent cooling system, according to the present invention, has the following advantages:

In the Cylinder Head:

1. Coolant flow can be generated by a low-energy-consumption electrical pump; which is directly controlled by the electronic control module.
2. The coolant volume submitted to forced flow (by the electric pump) is substantially lower, because the necessary coolant volume to cool the cylinder head is much lower than the volume required to cool the entire engine and the block alone. So, the required pumping work is lower.
3. Because of the lower coolant volume required, the control of the flow and of the coolant temperature in the cylinder head is faster and more accurate.
4. It makes possible to operate the cylinder head in the ideal working temperature which is usually different from that required by the engine block.
5. It does not require a thermostatic valve, as it needs only an electronic temperature sensor to automatically switch on the system.
6. It makes possible the use of a lower capacity radiator.
7. The use of independent radiators, makes possible their location in regions where the vehicle's frontal air flow is more favorable to heat transfer enhancement.
8. It makes possible better control of the engine pollutant emissions, due to the more accurate temperature control.
9. It makes possible the increase of the compression ratio and, consequently, the increase of the engine power output.
10. It makes possible better engine knocking control.
11. There is no need of any special cylinder head gasket.

In the Engine Block:

1. Flow occurs by natural (free) convection and, therefore, an auxiliary pump is not needed (mechanical or electric).
2. It is not necessary the use of a thermostatic valve. The system operates in a free circuit.
3. It has an independent radiator, which has lower capacity than the ones in current systems.
4. Because the flow occurs by means of free convection, it may operate at lower pressures.

What is claimed is:

1. A cooling system for an internal combustion engine comprising:

a) a cylinder head cooling subsystem including, a pump for flowing a first coolant from a first reservoir through a first radiator and a cylinder head of the engine, and a first temperature sensor for measuring the temperature of the first coolant in the subsystem, and regulating the flow of the first coolant flowed by said pump; and b) an engine block cooling subsystem, said engine block cooling subsystem being physically and functionally independent, and separate from said cylinder head cooling system, said engine block cooling subsystem including, a second reservoir filled with a second coolant, a second radiator in fluid communication with the second reservoir, and a conduit for accommodating flow of the second coolant to an engine block of the engine.

2. The cooling system of claim 1, wherein the cylinder head cooling subsystem includes a flow control valve responsive to the temperature sensor for controlling flow of said first coolant.

3. The cooling system of claim 2, including an electronic control device connecting the temperature sensor to the flow control valve.

4. The cooling system of claim 3, further including a fan for blowing cooling air onto said first radiator, the operation of the fan being controlled by said electronic control module.

5. The cooling system of claim 1, wherein the flow of the second coolant in the engine block cooling system is by natural thermodynamic flow, and no pump is provided in the engine block cooling subsystem.

6. The cooling system of claim 1, wherein the first and second radiators are disposed longitudinally of a vehicle axis associated with said engine.

7. The cooling system of claim 1, wherein the first and second radiators are disposed transversely of the vehicle axis associated with said engine.

* * * * *